US006311412B1

(12) United States Patent
Grilliot et al.

(10) Patent No.: US 6,311,412 B1
(45) Date of Patent: Nov. 6, 2001

(54) BOOT, LINER, INSOLE COMBINATION

(75) Inventors: William L. Grilliot; Mary I. Grilliot, both of Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 0 days.

(21) Appl. No.: 09/657,866

(22) Filed: Sep. 8, 2000

(51) Int. Cl.[7] ..... A43B 17/00

(52) U.S. Cl. ..... 36/10; 36/43; 36/80; 36/58.6; 36/88

(58) Field of Search ..... 36/10, 55, 113, 36/71, 117.6, 69, 88, 2 R, 43–44, 80, 58.6, 138, 7.3

(56) References Cited

U.S. PATENT DOCUMENTS

| | | | | |
|---|---|---|---|---|
| 2,440,563 | * | 4/1948 | Woyach | 36/7.3 |
| 4,790,082 | | 12/1988 | Pozzebon . | |
| 4,908,964 | * | 3/1990 | Deem | 36/88 |
| 5,692,321 | | 12/1997 | Holstine . | |
| 5,855,079 | * | 1/1999 | Herbert | 36/88 |
| 5,878,513 | | 3/1999 | Annovi et al. . | |
| 5,937,543 | * | 8/1999 | Hall et al. | 36/10 |
| 6,041,443 | | 3/2000 | Pas et al. . | |
| 6,134,717 | | 10/2000 | Grilliot et al. . | |

* cited by examiner

*Primary Examiner*—Paul T. Sewell
*Assistant Examiner*—Jila M. Mohandesi
(74) *Attorney, Agent, or Firm*—Rockey, Milnamow & Katz, Ltd.

(57) ABSTRACT

A liner and an insole, which are attached at a sole portion of the liner, are wearable with a boot, which is provided with a recess where an upper structure of the boot is affixed to a sole structure of the boot, at a heel end of the sole structure. At a heel end of the insole, the insole extends beyond heel portion of the liner so as to provide a tongue, which is fittable into the recess. The liner may be fixed to a pants leg. When the tongue is fitted into the recess, the liner is restrained against inverting and pulling from the boot, when the foot of the wearer is removed. The boot, liner, insole combination can be advantageously worn by a wearer, such as a firefighter, who needs quickly to don the combination and to doff the combination.

14 Claims, 1 Drawing Sheet

BOOT, LINER, INSOLE COMBINATION

TECHNICAL FIELD OF THE INVENTION

This invention pertains to a boot, liner, insole combination, which may be advantageously used if the liner is attached permanently to a pants leg, in which the liner is restrained against inverting and pulling from the boot, when the foot of the wearer is withdrawn, and which may be advantageously worn by a wearer, such as a firefighter, who needs quickly to don the combination and to doff the combination.

BACKGROUND OF THE INVENTION

A protective garment for a firefighter is known, in which a boot liner is attached permanently to the legs of a pair of pants. Such a garment is disclosed in U.S. patent application Ser. No. 09/197,046, which was filed on Nov. 20, 1998, and the disclosure of which is incorporated herein by reference.

A practice is known wherein the boot liners are fitted into the boots before the firefighter dons the protective garment and the boots, so that the firefighter can don the pants, boot liners, and boots together, as a combination, whereby potentially valuable time can be saved.

However, a negative consequence of the known practice with the pants, boot liners, and boots known heretofore is that, when the firefighter removes his or her foot from the boot and from the liner, the liner tends to invert and to pull from the boot. Usually, it would be preferable for the liner not to invert so that the combination of the pants, boot liners, and boots can be dried together for reuse.

SUMMARY OF THE INVENTION

According to a first aspect of this invention, this invention provides an improved combination comprising a boot, a liner, and an insole. The liner may be permanently attached to one leg of a pair of pants. Similarly, such a boot, such a liner, and such an insole may be employed at each leg of the pair of pants.

The boot has a sole structure, which has a toe end and a heel end, and an upper structure, which is affixed to the sole structure. The boot is provided where the upper structure is affixed to the sole structure, at the heel end of the sole structure, with a recess opening toward the toe end of the sole structure.

The liner, which is fittable into the boot, has a sole portion, which overlies the sole structure of the boot when the liner is fitted into the boot, and an upper portion, which is affixed to the sole portion and which fits within the upper structure of the boot when the liner is fitted into the boot. Preferably, the liner is made from a filamentary material, such as nylon, Kevlar™, or Nomex™, whereby the liner is easy to don and to doff.

The insole, which is fittable into the boot, with the liner, has a toe portion and a heel portion and is attached to the sole portion of the liner, at least at the toe and heel portions of the insole. The insole is attached to the sole portion of the liner permanently, as by stitching, or detachably, as by hook-and-loop fastening means. The insole is adapted to fit between the sole portion of the liner and the sole structure of the boot when the liner and the insole are fitted into the boot.

The insole extends at the heel portion of the insole, beyond the sole portion of the liner, so as to provide a tongue, which is adapted to fit into the recess when the liner and the insole are fitted into the boot. When fitted into the boot, the liner and the insole are not held to the boot, except by the tongue fitting into the recess.

According to a second aspect of this invention, this invention provides a combination comprising such a liner and such an insole for wearing with such a boot. According to a third aspect of this invention, this invention provides such a boot for wearing with such a liner and with such an insole.

Hereinbefore and hereinafter, where it is mentioned that one element is affixed to another element, it is contemplated that the affixed elements may be unitarily made.

DETAILED DESCRIPTION OF THE ILLUSTRATED EMBODIMENTS

Figure 1:
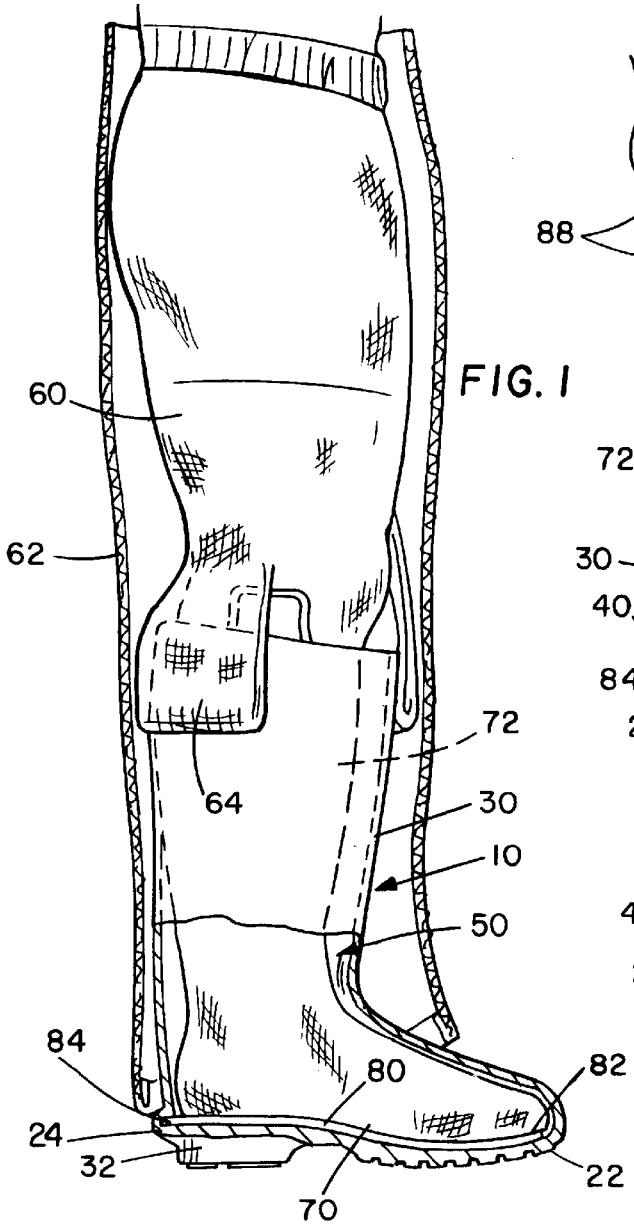
FIG. 1 is a cross-sectional view showing a combination embodying this invention and comprising a boot, a liner, and an insole. As shown, the liner is attached to one leg of a pair of inner pants serving as a thermal liner for a pair of outer pants, such as a pair of bunker pants for a firefighter.

As shown, a boot 10, a liner 50, and an insole 80 are combined in an embodiment of this invention. As described below, the liner 50 is restrained against inverting and pulling from the boot 10, when the foot of the wearer is withdrawn.

Although the boot 10 is shown as a predominantly rubber boot, this invention be embodied with a predominantly leather, polymeric, or fabric boot, or with a composite (e.g fabric and rubber) boot. Broadly, the boot 10 comprises a sole structure 20, which has a toe end 22 and a heel end 24, an upper structure 30, which is affixed to the sole structure 20 in a known manner, and a heel 32, which is affixed to the sole structure 20 in a known manner, at the heel end 24.

The boot 10 is similar to boots known heretofore so as to have multiple plies (not shown) of various materials at the sole structure 20 and multiple plies (not shown) of various materials at the upper structure 30, except that where the upper structure 30 is affixed to the sole structure 20, at the heel end 24 of the sole structure 20, the boot 10 is made so as to have a recess 40 opening toward the toe end 22 of the sole structure 20.

As shown in FIG. 1, the liner 50 is affixed by stitches or otherwise to one leg 60 of a pair of inner pants serving as a thermal liner for a pair of outer pants 62, such as a pair of bunker pants for a firefighter. The liner 50 and the leg 60 may be unitarily made. Preferably, the liner 50 is made from a filamentary material, such as nylon, Kevlar™, or Nomex™, whereby the liner is easy to don and to doff. As shown, the leg 60 has a cuff 64, which is similar to the cuff disclosed in U.S. patent application Ser. No. 09/197,046, supra.

The liner 50, which is fittable into the boot 10, has a sole portion 70, which overlies the sole structure 20 of the boot 10 when the liner 50 is fitted into the boot 10, and an upper portion 70, which is affixed by stitching or otherwise to the sole portion 60 and which fits within the upper structure 30 of the boot 10 when the liner 50 is fitted into the boot 10. The upper portion 70 and the sole portion 60 may be unitarily made.

Figure 4:
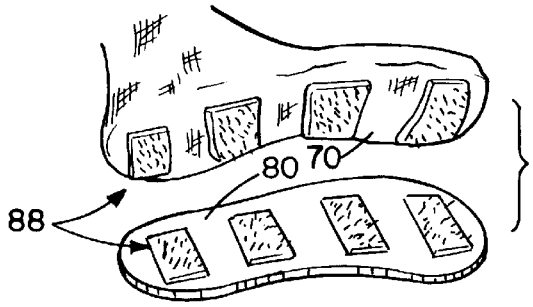
FIG. 4, on a scale similar to the scale of FIG. 3, is a fragmentary, exploded, perspective view showing an alternative way to attach the liner to the insole.
Figure 3:
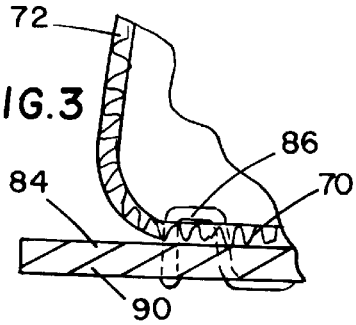
FIG. 3, on a scale similar to the scale of FIG. 1, is a fragmentary, cross-sectional view showing one possible way to attach the liner to the insole.
Figure 2:
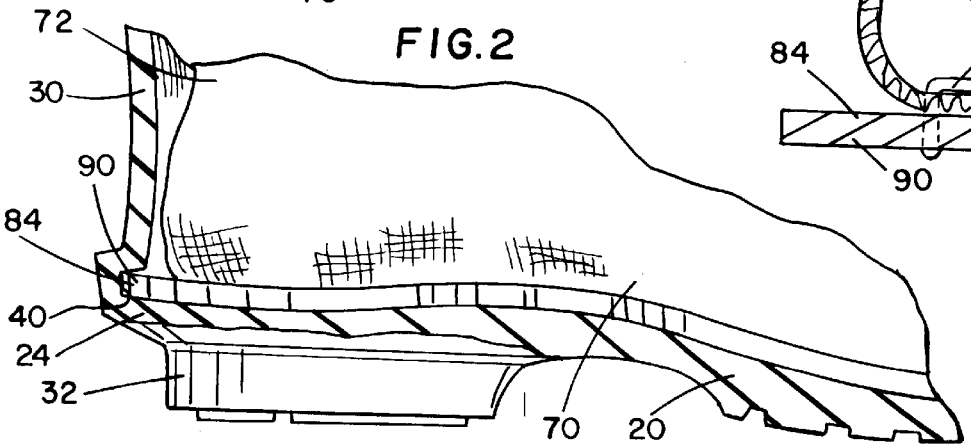
FIG. 2, on a larger scale, is a detail taken from FIG. 1 and enlarged to show a sole structure of the boot, a sole portion of the liner, and the insole, at a heel portion of the insole.

The insole 80, which is fittable into the boot 10, with the liner 50, has a toe portion 82 and a heel portion 84. The insole 80 is attached to the sole portion 70 of the liner 50, at least at the toe portion 82 and at the heel portion 84. The insole 80 can be attached to the sole portion 60 of the liner 50 permanently, as by stitching 86 as shown in FIG. 3, or detachably, as by hook-and-loop fastening means 88 (e.g. Velcro™ hook-and-loop fasteners) as shown in FIG. 4. The insole 80 is adapted to fit between the sole portion 70 of the liner 50 and the sole structure 20 of the boot 10 when the liner 50 and the insole 80 are fitted into the boot 10.

At the heel portion 84, the insole 80 extends beyond the sole portion 70 of the liner 50 so as to provide a tongue 90, which is adapted to fit into the recess 40 when the liner 50 and the insole 80 are fitted into the boot 10. When fitted into the boot 10, the liner 50 and the insole 80 are not held to the boot, except by the tongue fitting into the recess.

Figure 5:
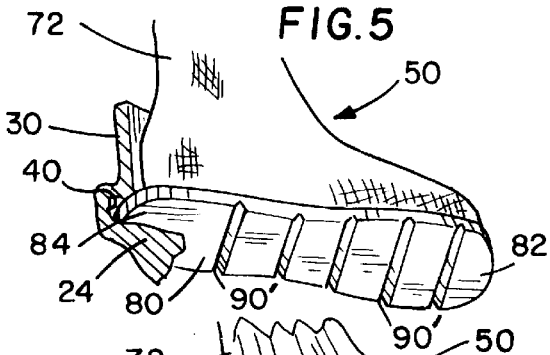
FIGS. 5 and 6, on a scale similar to the scale of FIG. 4, are fragmentary, cross-sectional views showing one possible construction of the insole.
Figure 6:
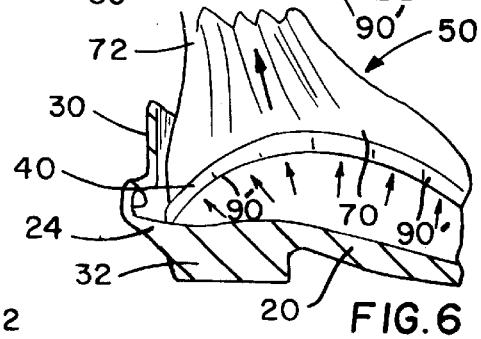

Various rubberized fiber, polymeric, or other materials in sheet forms are useful to make the insole 80, which must be somewhat stiff, as compared to the liner 50, but which must have some flexibility to permit the liner 50 and the insole 80 to be fitted into the boot 10 and to be withdrawn from the boot 10. If more flexibility is needed, the insole 80 can be made with transverse grooves 90' opening downwardly, as shown in FIG. 5, so as to provide the insole 80 with more flexibility.

The insole extends at the heel portion of the insole, beyond the sole portion of the liner, so as to provide a tongue, which is adapted to fit into the recess when the liner and the insole are fitted into the boot. When fitted into the boot, the liner and the insole are not held to the boot, except by the tongue fitting into the recess.

What is claimed is:

1. A combination comprising a boot, a liner, and an insole, wherein the boot has a sole structure, which has a toe end and a heel end, wherein the boot has an upper structure, which is affixed to the sole structure, and wherein the boot is provided where the upper structure is affixed to the sole structure, at the heel end of the sole structure, with a recess opening toward the toe end of the sole structure, wherein the liner is fittable into the boot, wherein the liner has a sole portion, which overlies the sole structure of the boot when the liner is fitted into the boot, and wherein the liner has an upper portion, which is affixed to the sole portion and which fits within the upper structure of the boot when the liner is fitted into the boot, wherein the insole is fittable into the boot, with the liner, wherein the insole has a toe portion and a heel portion, the insole being attached to the sole portion of the liner, at least at the toe and heel portions of the insole, wherein the insole is adapted to fit between the sole portion of the liner and the sole structure of the boot when the liner and the insole are fitted into the boot, wherein the insole extends at the heel portion of the insole, beyond the sole portion of the liner, so as to provide a tongue, which is adapted to fit into the recess when the liner and the insole are fitted into the boot, and wherein the liner and the insole are not held to the boot when fitted into the boot, except by the tongue fitting into the recess.

2. The combination of claim 1 wherein the insole is attached permanently to the sole portion of the liner.

3. The combination of claim 2 wherein the insole is attached by stitching to the sole portion of the liner.

4. The combination of claim 1 wherein the insole is attached detachably to the sole portion of the liner.

5. The combination of claim 4 wherein the insole is attached by hook-and-loop fastening means to the sole portion of the liner.

6. The combination of claim 1, 2, 3, 4, or 5 wherein the liner is attached permanently to a pants leg.

7. The combination of claim 1, 2, 3, 4, or 5 wherein the liner is made from a filamentary material.

8. The combination of claim 7 wherein the liner is attached permanently to a pants leg.

9. A combination comprising a liner and an insole for wearing with a boot, which has a sole structure and an upper structure and which is provided where the upper structure is affixed to the sole structure, at a heel end of the sole structure, with a recess opening toward a toe end of the sole structure, wherein the liner is fittable into the boot, wherein the liner has a sole portion, which overlies the sole structure of the boot when the liner is fitted into the boot, and wherein the liner has an upper portion, which is affixed to with the sole portion and which fits within the upper structure of the boot when the liner is fitted into the boot, wherein the insole is fittable into the boot, with the liner, wherein the insole has a toe portion and a heel portion, the insole being attached to the sole portion of the liner, at least at the toe and heel portions of the insole, wherein the insole is adapted to fit between the sole portion of the liner and the sole structure of the boot when the liner and the insole are fitted into the boot, and wherein the insole extends at the heel portion of the insole, beyond the sole portion of the liner, so as to provide a tongue, which is adapted to fit into the recess when the liner and the insole are fitted into the boot.

10. The combination of claim 9 wherein the insole is attached permanently to the sole portion of the liner.

11. The combination of claim 10 wherein the insole is attached by stitching to the sole portion of the liner.

12. The combination of claim 1 wherein the insole is attached detachably to the sole portion of the liner.

13. The combination of claim 10 wherein the insole is attached by hook-and-loop fastening means to the sole portion of the liner.

14. The combination of claim 9, 10, 11, 12, or 13 wherein the liner is attached permanently to a pants leg.

* * * * *